US010823169B2

(12) United States Patent
Flavelle et al.

(10) Patent No.: US 10,823,169 B2
(45) Date of Patent: Nov. 3, 2020

(54) GEAR PUMP WITH GEAR HAVING INTERSPERSED VANES

(71) Applicant: Roper Pump Company, Commerce, GA (US)

(72) Inventors: William D. Flavelle, Hoschton, GA (US); Michael Andrew Ingram, Oakwood, GA (US)

(73) Assignee: Roper Pump Company, Commerce, GA (US)

( * ) Notice: Subject to any disclaimer, the term of this patent is extended or adjusted under 35 U.S.C. 154(b) by 271 days.

(21) Appl. No.: 15/817,961

(22) Filed: Nov. 20, 2017

(65) Prior Publication Data

US 2018/0202437 A1 Jul. 19, 2018

Related U.S. Application Data

(60) Provisional application No. 62/446,928, filed on Jan. 17, 2017.

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 2/00*** | (2006.01) |
| ***F04C 2/344*** | (2006.01) |
| ***F04C 2/18*** | (2006.01) |
| ***F01C 19/00*** | (2006.01) |
| ***F04C 15/00*** | (2006.01) |
| ***F04C 2/08*** | (2006.01) |

(52) U.S. Cl.

CPC ..... *F04C 2/344* (2013.01); *F01C 19/005* (2013.01); *F04C 2/084* (2013.01); *F04C 2/18* (2013.01); *F04C 15/0019* (2013.01); *F04C 2240/30* (2013.01); *F04C 2250/20* (2013.01)

(58) Field of Classification Search

CPC ..... F01C 19/005; F04C 2/084; F04C 2/18; F04C 2/344; F04C 15/0019; F04C 2240/30; F04C 2250/20

USPC ... 418/134, 191, 206.1–206.6, 259, 266–268

See application file for complete search history.

(56) References Cited

U.S. PATENT DOCUMENTS

| | | |
|---|---|---|
| 137,055 A | 3/1873 | Chapman |
| 345,885 A | 7/1886 | Colebrook |

(Continued)

FOREIGN PATENT DOCUMENTS

DE 102010049439 A1 4/2012

*Primary Examiner* — Theresa Trieu

(74) *Attorney, Agent, or Firm* — Snyder, Clark, Lesch & Chung, LLP

(57) ABSTRACT

A pump fluid driving apparatus includes a housing having a chamber, with two gears mounted within the chamber. The housing includes a first rounded wall section and a second rounded wall section, the first and second rounded wall sections defining at least a portion of the chamber. The gears have teeth located about their respective peripheries and operatively positioned with the teeth of the first gear and the teeth of the second gear intermeshed. The teeth include slotted teeth and solid teeth arranged with uniform spacing in a repeating pattern about the periphery of each of the gears, with each of the slotted teeth having a vane slot and a radially extending vane extending from the vane slot, and each radially extending vane being movable within the respective vane slot and being configured to contact the respective first or second rounded wall sections.

18 Claims, 7 Drawing Sheets

(56) References Cited

U.S. PATENT DOCUMENTS

| | | | | | |
|---|---|---|---|---|---|
| 931,900 | A | | 8/1909 | Tompkins | |
| 1,436,263 | A | | 11/1922 | Johnson | |
| 1,923,268 | A | | 8/1933 | Jensen | |
| 2,134,153 | A | * | 10/1938 | Seyvertsen | F04C 2/084 418/134 |
| 2,210,152 | A | * | 8/1940 | Nelson | F04C 2/084 418/134 |
| 2,270,222 | A | | 1/1942 | Rea et al. | |
| 2,897,765 | A | * | 8/1959 | Kitano | F04C 2/084 418/206.5 |
| 3,306,228 | A | | 2/1967 | Drutchas | |
| 4,087,215 | A | | 5/1978 | Miller | |
| 8,257,069 | B2 | | 9/2012 | Satanovskiy | |
| 8,801,411 | B2 | | 8/2014 | Mori | |
| 9,022,761 | B2 | | 5/2015 | Flavelle | |
| 2015/0204326 | A1 | | 7/2015 | Tsukahara et al. | |

* cited by examiner

GEAR PUMP WITH GEAR HAVING INTERSPERSED VANES

CROSS-REFERENCE TO RELATED APPLICATION

This application claims priority under 35 U.S.C. § 119, based on U.S. Provisional Patent Application No. 62/446,928 filed Jan. 17, 2017, the disclosure of which is hereby incorporated by reference herein.

BACKGROUND OF THE INVENTION

The present invention relates generally to gears used in pumps, and more particularly, to gears of positive displacement gear pumps.

Standard gear pumps work well with thick (or high viscosity) fluids because of a large cavity volume allowing the thick fluid to easily flow into the pump. The clearances between the gears and housing do not have a significant effect on pumping efficiency when pumping thick fluids as the fluid tends to 'seal' the clearances resulting in high pumping efficiency. When pumping thin (or low viscosity) fluids, the clearances between the gears and the housing on standard gear pumps allow the thin fluids to 'leak' between the gears and housing during pumping. Therefore, standard gear pumps are relatively inefficient for thin fluids.

By contrast, thin fluids are pumped efficiently by regular vane pumps due to the constant contact of vanes with the housing. However, standard vane pumps do not handle thick fluids well because the swept volume of the pump is small, which restricts the inflow of the thick fluid into the pump. Additionally, the vanes tend to become clogged by the thick fluid preventing them from sealing.

DETAILED DESCRIPTION OF THE PREFERRED EMBODIMENTS

The following detailed description refers to the accompanying drawings. The same reference numbers in different drawings may identify the same or similar elements.

Exemplary embodiments for a pump fluid driving apparatus are described with reference to FIGS. 1-7. According to an implementation described herein, the pump fluid driving apparatus includes a housing having a chamber, with two gears (e.g., a driven gear and an idler gear) mounted within the chamber. The housing includes a first rounded wall section and a second rounded wall section, the first and second rounded wall sections defining at least a portion of the chamber. The two gears include a first gear and a second gear mounted for rotation about their respective centers within the chamber and are disposed adjacent, respectively, the first and second wall sections. Each of the first and second gears has teeth located about its respective periphery and operatively positioned with the teeth of the first gear and the teeth of the second gear intermeshed for all angular positions in a rotation of the first and second gears. The teeth may include slotted teeth and solid teeth arranged with uniform spacing in a repeating pattern about the periphery of each of the gears, with each of the slotted teeth having a vane slot and a radially extending vane extending from the vane slot, and each radially extending vane being movable within the respective vane slot and being configured to contact the respective first or second rounded wall sections.

Pumps optimized for a particular environment may be damaged or underperform in an environment with fluids having different properties, such as an environment that includes alternating volumes of thick fluids and thin fluids. The combination of gear teeth with vanes and regular (or solid) gear teeth, as described herein, provides a pump that can handle thick and thin fluids efficiently. The vanes provide a contact seal with the housing for efficiently pumping thin fluids. Thick fluids may present clogging issues for the gear teeth with vanes. However, if the vanes become clogged, the large cavity volume and larger clearances between the solid gear teeth allow for efficient pumping of the thick fluid and thereby avoid clogging problems.

Figure 1:
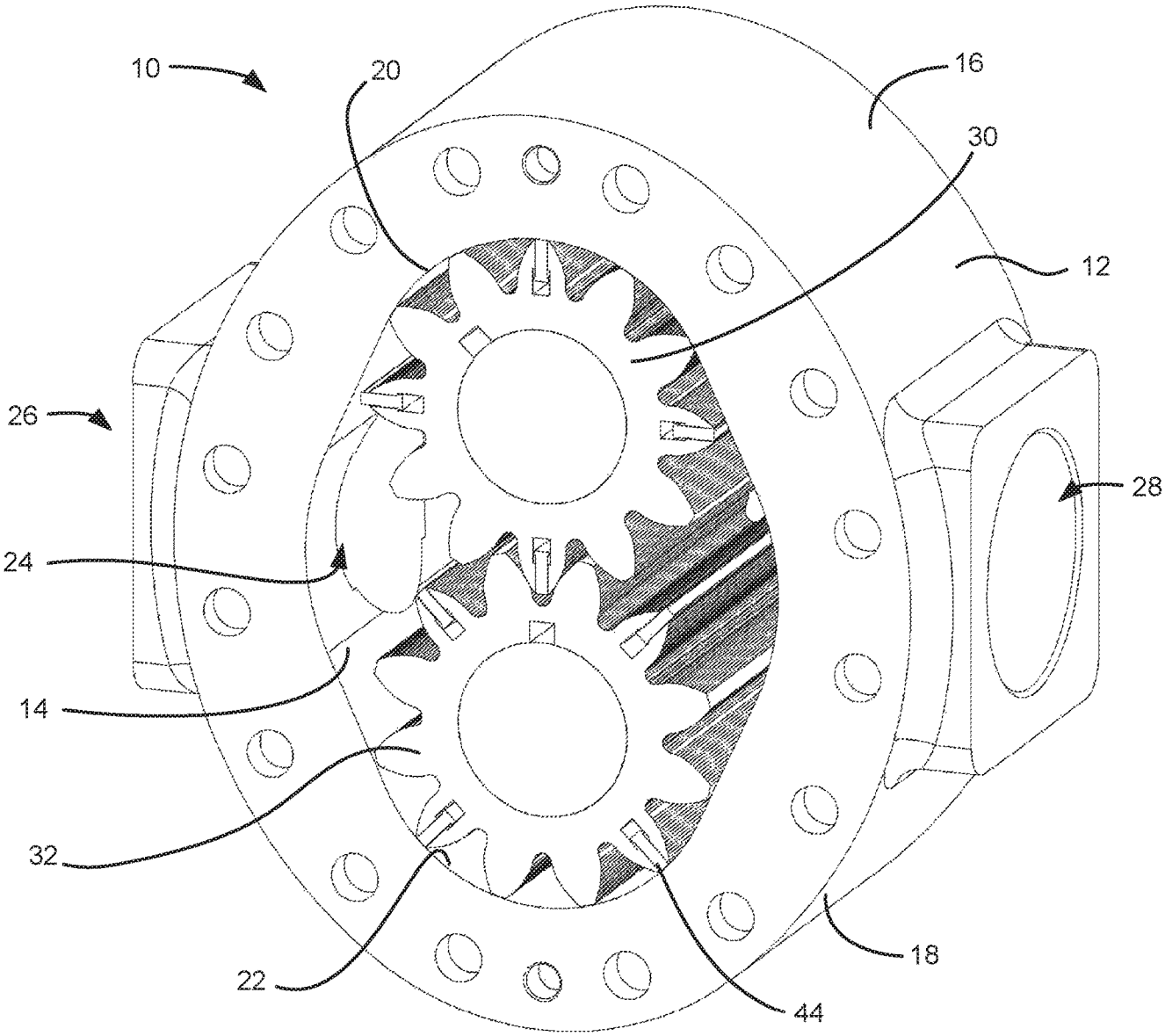
FIG. 1 is a perspective view of a fluid driving apparatus of a pump or flow meter according to an implementation described herein.

Other advantages, characteristics and details of the invention will emerge from the explanatory description provided below with reference to the attached drawings and examples, but it should be understood that the present invention is not deemed to be limited thereto. To that end, FIG. 1 depicts an exemplary pump fluid driving apparatus 10. The pump fluid driving apparatus 10 includes a main body as a housing 12 with a gear chamber 14. Housing 12 may be formed (e.g., cast, machined, etc.) as a single piece or may be formed by joining multiple body sections, such as first and second body plates 16, 18, to form gear chamber 14. Gear chamber 14 may include first and second rounded wall sections 20 and 22. The first and second rounded wall sections 20, 22 are positioned within the housing 12, and housing 12 include two spaced apertures 24 (only one being visible in FIG. 1) between the first and second rounded wall sections 20, 22. The apertures 24 communicate with a respective inlet 26 and outlet 28. In some implementations, one or more connecting wall sections 21, 23 (shown in FIG. 2) may be interposed between rounded wall sections 20 and 22 to further define gear chamber 14. Connecting wall sections 21, 23 may have a different radius (or multiple different radii) than that of rounded wall sections 20, 22. Inlet 26 and outlet 28 are not limited by their size or shape, but by their location generally on opposite sides of gear chamber 14 in the preferred examples.

Spaced apertures 24 register with the inlet 26 and the outlet 28, with the inlet 26 being open to an inlet passage of the pump, and the outlet 28 being open to an outlet passage of the pump. Gear chamber 14 is closed on its front and rear side for a fluid-tight seal within housing 12 in this example, as understood by one skilled in the art.

Figure 2:
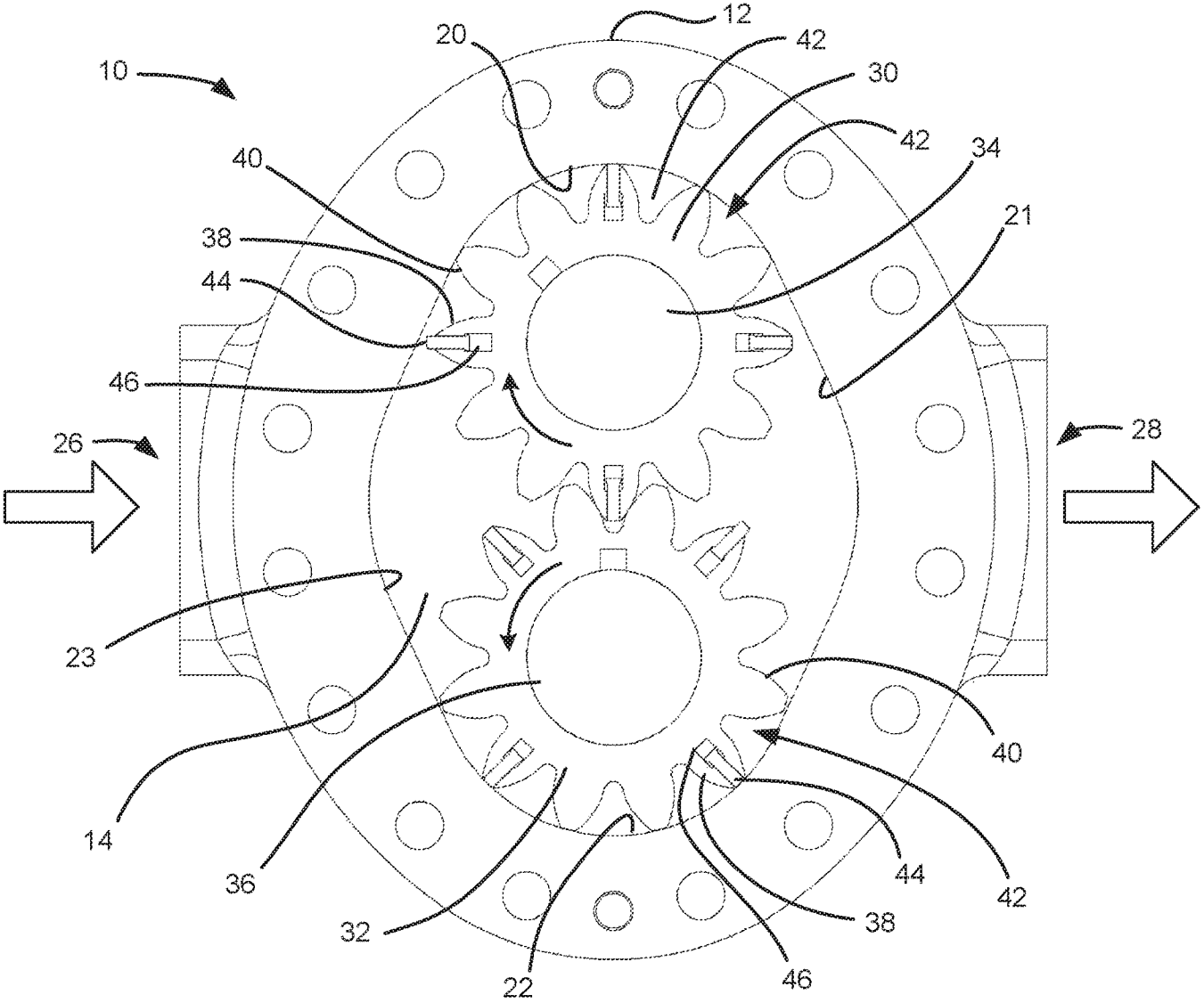
FIG. 2 is a side view of the driving apparatus illustrated in FIG. 1.

Referring to FIGS. 1 and 2, a pair of spur gears 30, 32 is journaled in gear chamber 14. Gear 30 is mounted for rotation about an axis rod or axle 34 (FIG. 2) at its center, which corresponds with a center of curvature of rounded wall section 20. Gear 32 is mounted for rotation about an axle 36 (FIG. 2), which is disposed at center of curvature of rounded wall section 22. In one implementation, gears 30 and 32 may be circular and have identical shapes. In another implementation, gears 30 and 32 may have identical elliptical shapes.

Gears 30 and 32 have peripheral teeth 38 and 40 that intermesh so that the rotation of one of the gears, for example, gear 30 that may be linked to a pump motor, causes rotation of the other gear. Teeth 38 and 40 of gears 30 and 32 may have uniform sizes, and are machined to intermesh for all angular positions in a rotation of the gears. In one implementation, each gear 30 and 32 has slotted teeth 38 and solid teeth 40 arranged with uniform spacing in a repeating pattern about the periphery. In this example of a twelve-tooth gear, each slotted tooth 38 is separated by two solid teeth 40. In other implementations, more or fewer teeth 38, 40 may be used in different arrangements. For example, in another implementation, an eight- or ten-tooth gear may be used with an equal number of alternating slotted teeth 38 and solid teeth 40. In still another implementation, the arrangement of slotted teeth 38 and solid teeth 40 may be asymmetrically arranged around the about the periphery of gear 30 or 32. As one example, regardless of the number of total teeth in each gear, slotted teeth 38 may make up no more than half of the total number of teeth for gear 30 or 32. In another implementation, slotted teeth 38 may make up no more than one third of the total number of teeth for gear 30 or 32. In still another implementation, all of the teeth in gears 30 and 32 may be slotted teeth 38. The uniform size and spacing of slotted teeth 38 and solid teeth 40 may permit different angular orientations of gears 30 and 32, which may provide for simplified installation, and may provide improved wear/noise characteristics (e.g., over geared systems with non-uniform teeth spacing) for pump fluid driving apparatus 10.

Teeth 38 and 40 may be formed to provide a profile with a radius or curvature nearly equal to the radius or curvature of rounded wall sections 20, 22. However, the radius of rounded wall sections 20, 22 may be slightly greater than the radius of gears 30, 32 to, for example, provide radial clearance between gears 30, 32 and respective rounded wall sections 20, 22. It is also noted that gears 30, 32 are provided with identical gaps 42 between each of adjacent teeth 38 and 40.

Figure 3:
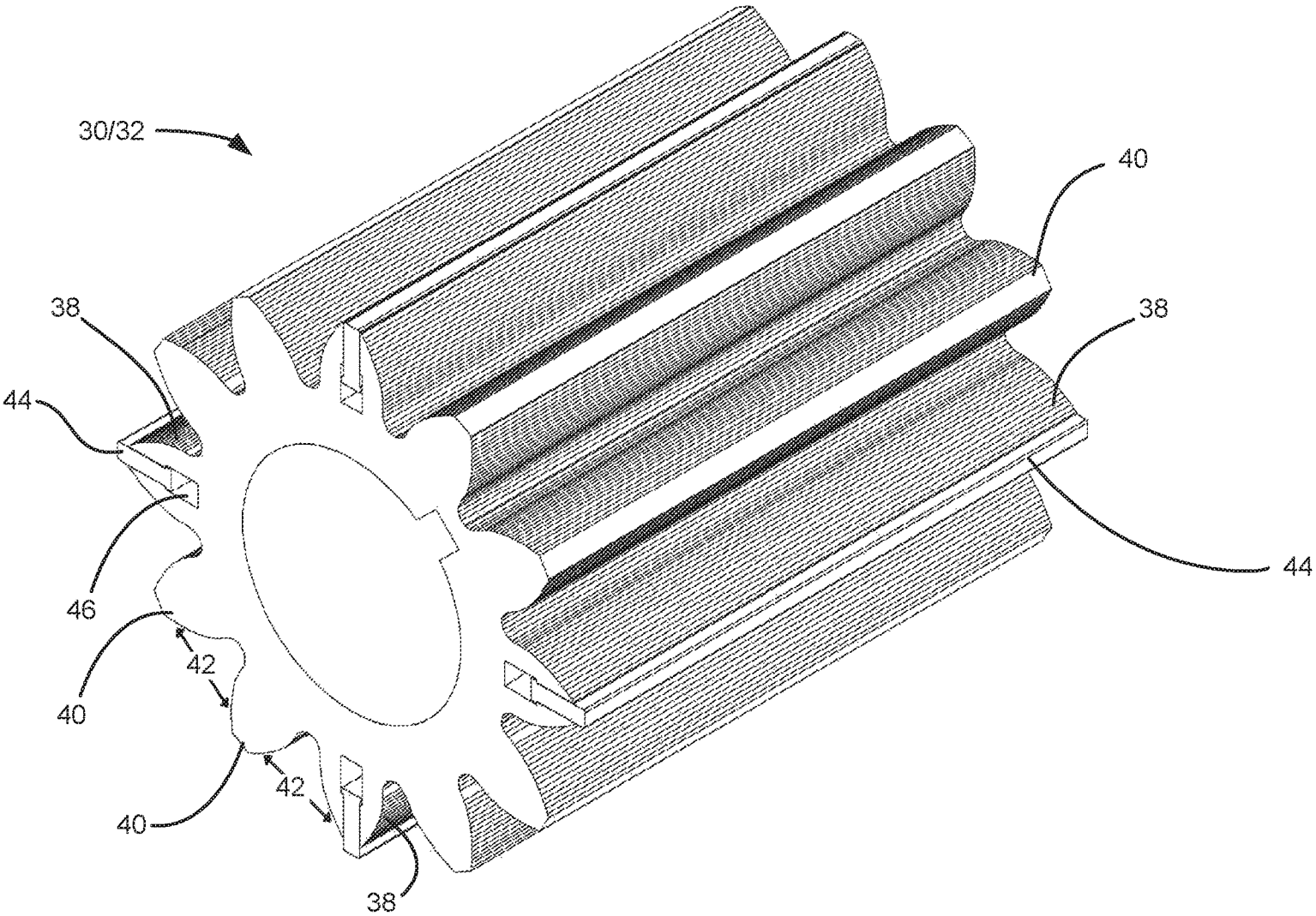
FIG. 3 is a perspective view of a gear of FIG. 1.

Still referring to FIGS. 1 and 2, slotted teeth 38 include radially extending wipers or vanes 44 that seal liquid slip paths (e.g., radial running clearance areas) that typically exist between the outer ends of teeth 38 and the portion of the case bore defined by rounded wall sections 20, 22. While not being limited to a particular theory, the radially extending vanes 44 are disposed within and extend out of respective vane slots 46 formed in slotted teeth 38 and extend within the gears toward the respective axle or shaft 34, 36. In one implementation, each of slotted teeth 38 and solid teeth 40 have a same profile along a right flank and a left flank, and each vane slot 46 is centered symmetrically, as illustrated in FIGS. 3 and 4A, between the right and left flank of the respective slotted tooth 38, allowing for interchangeable orientation of gears 30, 32. Additionally, the consistent dimension of gaps 42 between each of teeth 38 and 40 allows gears 30, 32 to be meshed in any rotational orientation about axels 34, 36.

FIG. 4A shows an enlarged cross-sectional view of a portion of slotted tooth 38. The size of vane slot 46 is small enough to not sacrifice the structural integrity of slotted tooth 38 for use with thick fluids. In one implementation, as shown in FIG. 4A, each slotted tooth 38 may be configured such that a cross-sectional area of vane slot 46 is less than a total cross-sectional area of tooth 38 on both sides of vane slot 46. Other configurations are possible depending, in part, on the strength of material for slotted tooth 38. As shown in FIG. 4A each vane slot 46 may have a tip width, $W_T$, and a base width, $W_B$, such that a pair of shoulders 47 is formed at the transition between $W_T$ and $W_B$.

Figure 4B:
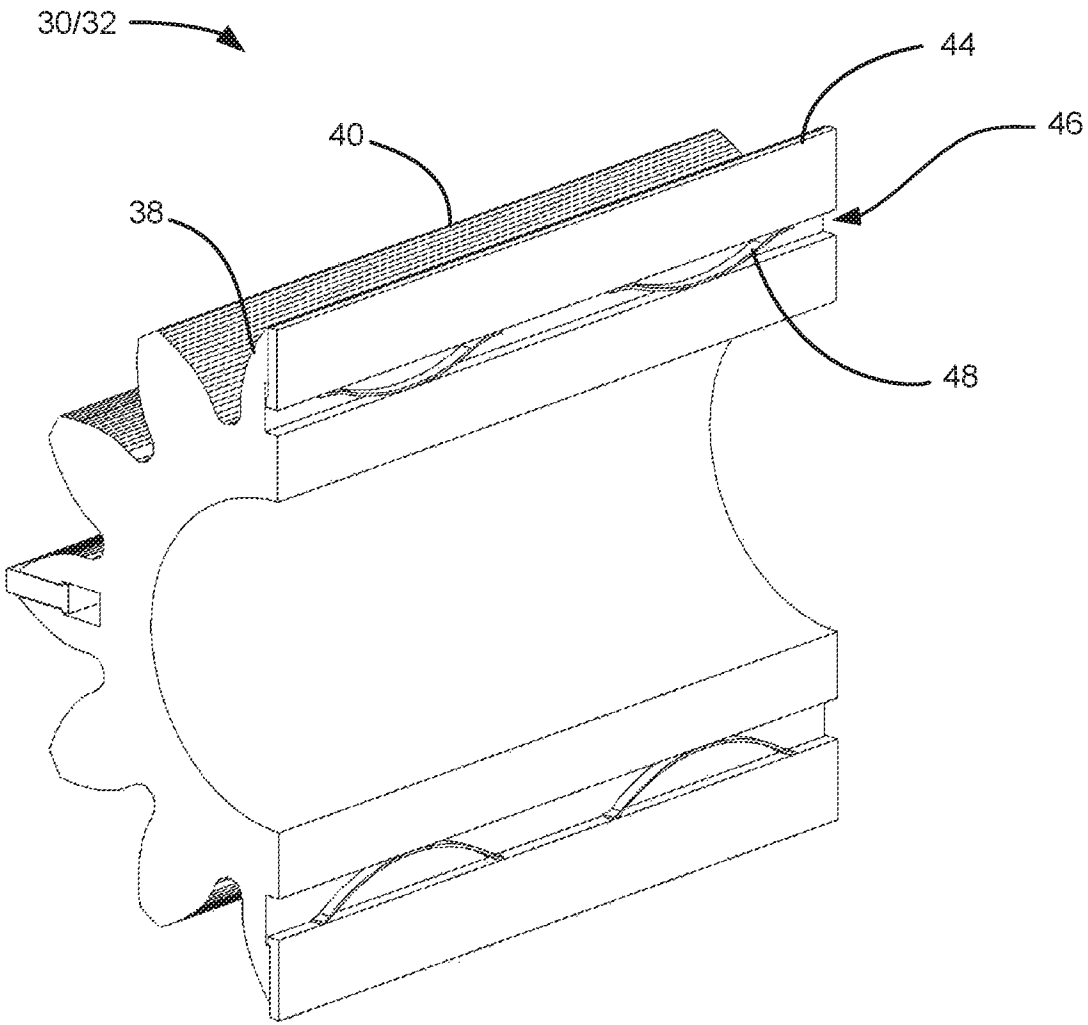
FIG. 4B is a partial section perspective view of the gear of FIG. 3.
Figure 4A:
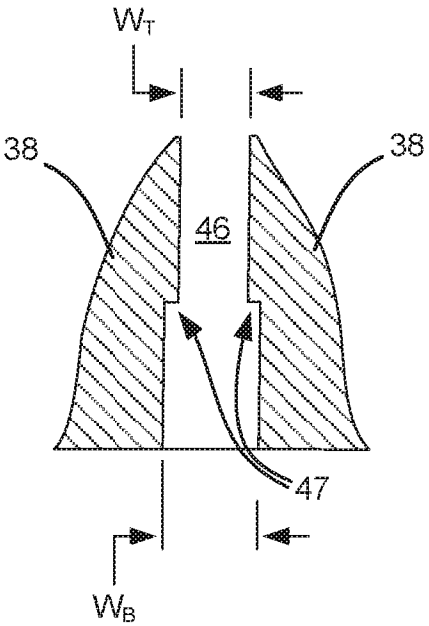
FIG. 4A is a cross-sectional view of a portion of a slotted gear tooth of FIG. 2.

FIG. 4B is a partial section perspective view of the gear 30, 32. As shown, for example, in FIG. 4B, centrifugal force and/or an outward bias that may be provided by, for example, springs 48 (e.g., leaf springs, coiled springs, etc.) within the vane slots 46, urge each vane 44 radially outward into contact with rounded wall sections 20, 22. Shoulders 47 (FIG. 4A) in each vane slot 46 provide interference to prevent a base of vane 44 and springs 48 from extending radially out of vane slot 46. It is understood that gear rotation is required for centrifugal force to urge the vanes outward, while springs 48 may be used to urge vanes 44 outwards regardless of rotation. The maximum outward extension of vane 44 beyond the tip of slotted tooth 38 may be greater than the clearance between gears 30, 32 and rounded wall sections 20, 22. For example, the extension of vane 44 past the tip of slotted tooth 38 may be larger than the difference between the radius of rounded wall sections 20, 22 and the radius of gears 30, 32, such that vane 44 contacts rounded wall sections 20, 22 during rotation of gears 30, 32 and provides contact pressure between vane 44 and rounded wall sections 20, 22.

As shown in FIGS. 1 and 2, during operation, fluid is drawn from inlet 26 into an increasing volume defined by chamber 14. The drawn fluid is swept from inlet 26 by intermeshing gears 30, 32 and vanes 44 across chamber 14 to outlet 28 where the fluid is forced out of housing 12. During the rotation of gears 30 and 32, vanes 44 are extended when slotted teeth 38 are not intermeshed with the opposing gear 30 or 32, preferably extending vane 44 out to the respective rounded wall section 20, 22, to help seal the radial clearance slip path. During intermeshing, the adjacent gear 30 or 32 push vanes 44 back into vane slot 46, against the centrifugal force and/or spring bias, as the respective slotted tooth 38 is intermeshed with the adjacent gear at tooth gap 42.

It is also understood that extendable vanes 44 are not required to actually contact the surface of the tooth gap 42 of the adjacent gear 30 or 32 during rotation. In particular, the extension length of vanes 44 beyond the tips of slotted teeth 38 and the depth and shape of tooth gaps 42 can be designed so the end of vane 44 never contacts the surface of the tooth gap when the gears 30, 32 mesh for spatial clearance between the vanes and tooth gaps. As described further below, gears 30 and 32 may have either straight spur teeth or helically oriented teeth (FIG. 7), although the invention is not limited to these shapes.

Preferably housing 12, and gears 30, 32, are made of metal or other hard durable material. For example, gears 30, 32 may preferably be made of stainless steel. In other implementations, housing 12 may be made from plastics. Vanes 44 may be made of an engineered plastic, metal, a resin, rubber, polypropylene, or other materials. Springs 48 may be formed of a metal, such as stainless steel, or other materials, such as plastic, both strong and resilient to function as a biasing member.

Figure 5:
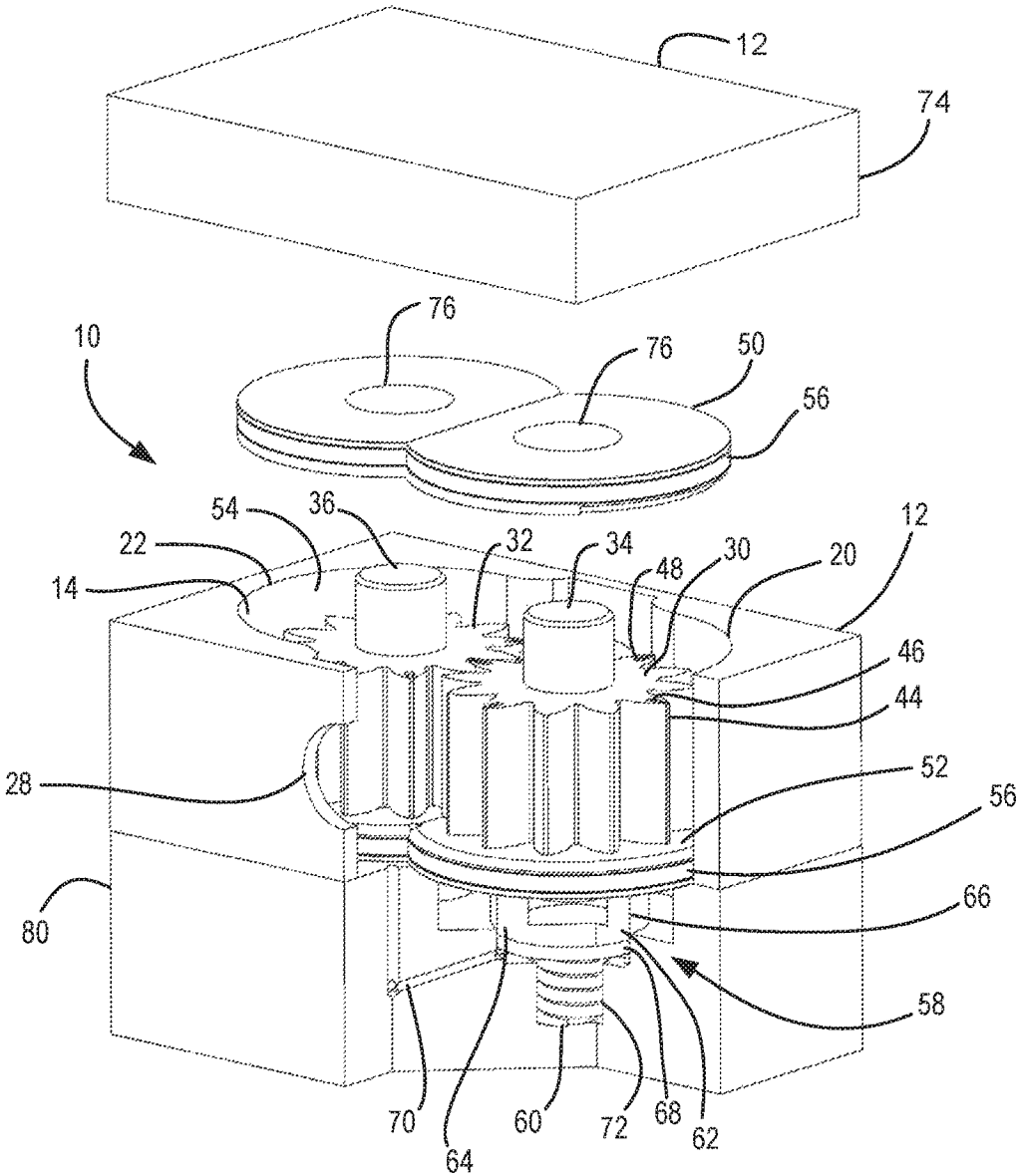
FIG. 5 is a perspective view, partially in section, of another exemplary fluid driving apparatus.

FIG. 5 depicts fluid driving apparatus 10 in partly exploded perspective view. The exemplary apparatus is similar to the apparatus discussed above and depicted by example in FIGS. 1 and 2. The fluid driving apparatus 10 depicted in FIG. 5 further includes floating side plates 50 and 52 added to seal off lateral slip paths on both sides of the gears 30, 32. Floating side plates 50, 52 are disposed within a housing bore 54 where the side plates 50, 52 are sealed against rounded wall sections 20, 22 to define gear chamber 14 there between. Floating side plates 50, 52 are preferably made out of a metal or other hard durable material (e.g., stainless steel, resin, polyurethane, bronze, carbon, cast iron, plastic, etc.). Plates 50, 52 may each include a gasket 56 wrapped about the radial periphery of the plates to help form the seal between plates 50, 52 and rounded wall sections 20, 22. Plates 50, 52 also include aperture channels 76 that slide about respective shafts 34, 36 and allow the plates to fit against gears 30, 32 within housing bore 54.

As can be seen in FIG. 5, plates 50, 52 may be "floating plates" as they can slide transversely within the rounded wall sections 20, 22 while maintaining a seal of the fluids within gear chamber 14 regardless of the viscosity of the fluids. In order to keep a fluid-tight relationship between floating side plates 50, 52 with gears 30, 32 in between, a bias may be applied to at least one of the side plates, as shown by example in FIG. 5. In particular, side plate 52 may be biased toward gears 30, 32 and side plate 50 by a biasing unit 58 in a main body 80 of housing 12. In this example, biasing unit 58 includes a compression spring 60 in contact with a piston 62 adapted to apply a bias from biasing unit 58 to plate 52 without interfering with shaft 34, which maybe a drive shaft. Piston 62 may be a lateral clearance pressure piston including a disk wall 64 and a sleeve section 66 that slides about shaft 34 without interfering with the rotation of the shaft, and abuts floating slide plate 52. An o-ring 68 may be placed between piston 62 and main body 80 to further prevent leakage.

To further maintain a balance bias against piston 62, main body 80 may be provided with a tunnel 70 providing fluid communication between gear chamber 14 and a spring chamber 72 that houses spring 60. Under pressure (e.g., during pump operation), fluid from gear chamber 14 may be forced under pressure into spring chamber 72 to thereby hydraulically activate piston 62 into floating side plate 52 and further maintain a tight fitted relationship between floating side plates 50, 52 opposite gears 30, 32. When the pumping operation ceases, the relaxation of fluid pressure in tunnel 70 and spring chamber 72 allows a relaxation of the bias against floating slide plate 52, which may allow a cover 74 of the housing 12 to be safely removed for access to gear chamber 14. However, it is beneficial that during use, the heightened fluid pressure provided during the pumping operation urges floating side plates 50, 52 together to seal off lateral slip paths on the sides of gears 30, 32.

Figure 6:
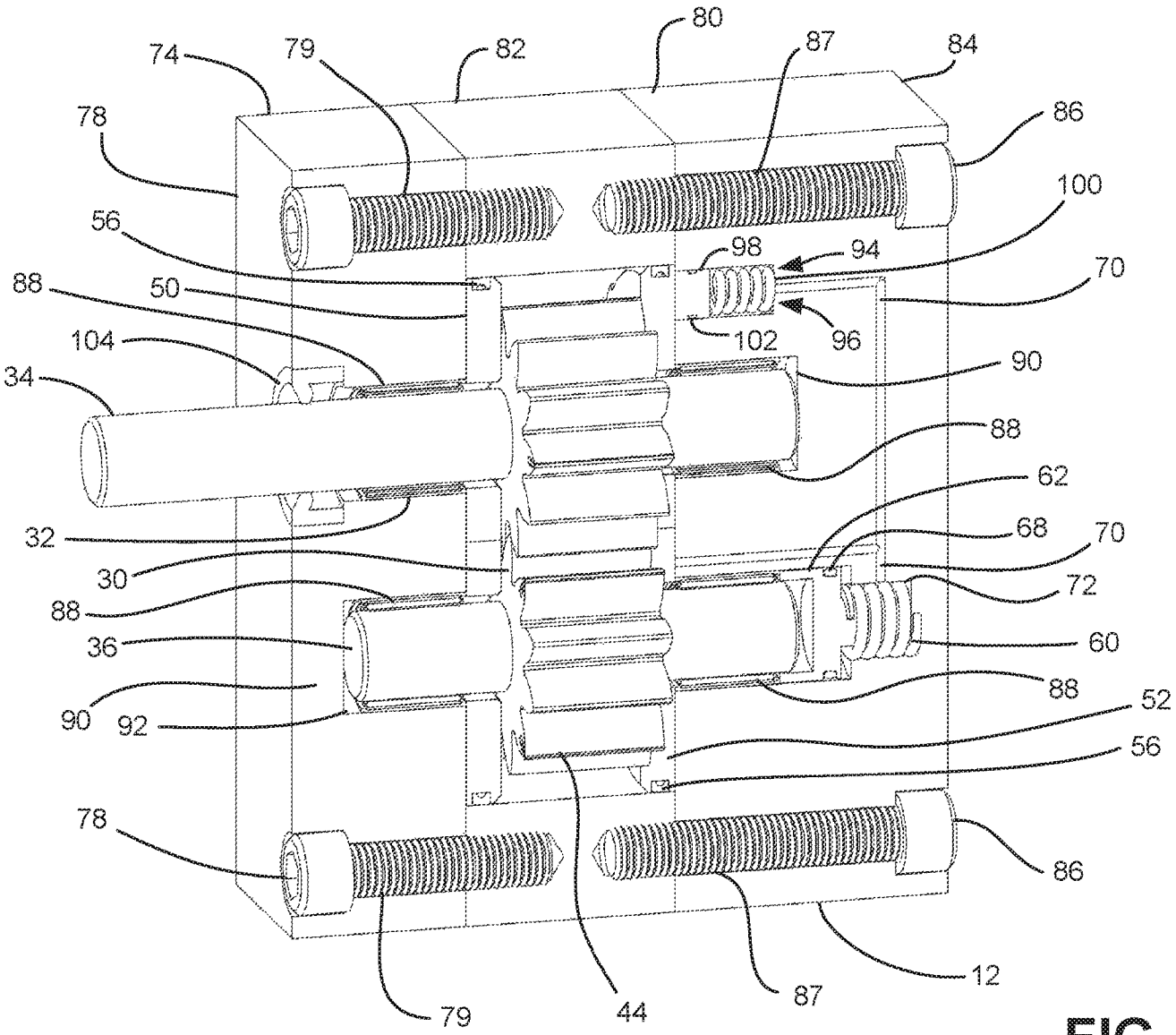
FIG. 6 is a perspective view, partially in section, of yet another exemplary driving apparatus according to an implementation described herein.
Figure 7:
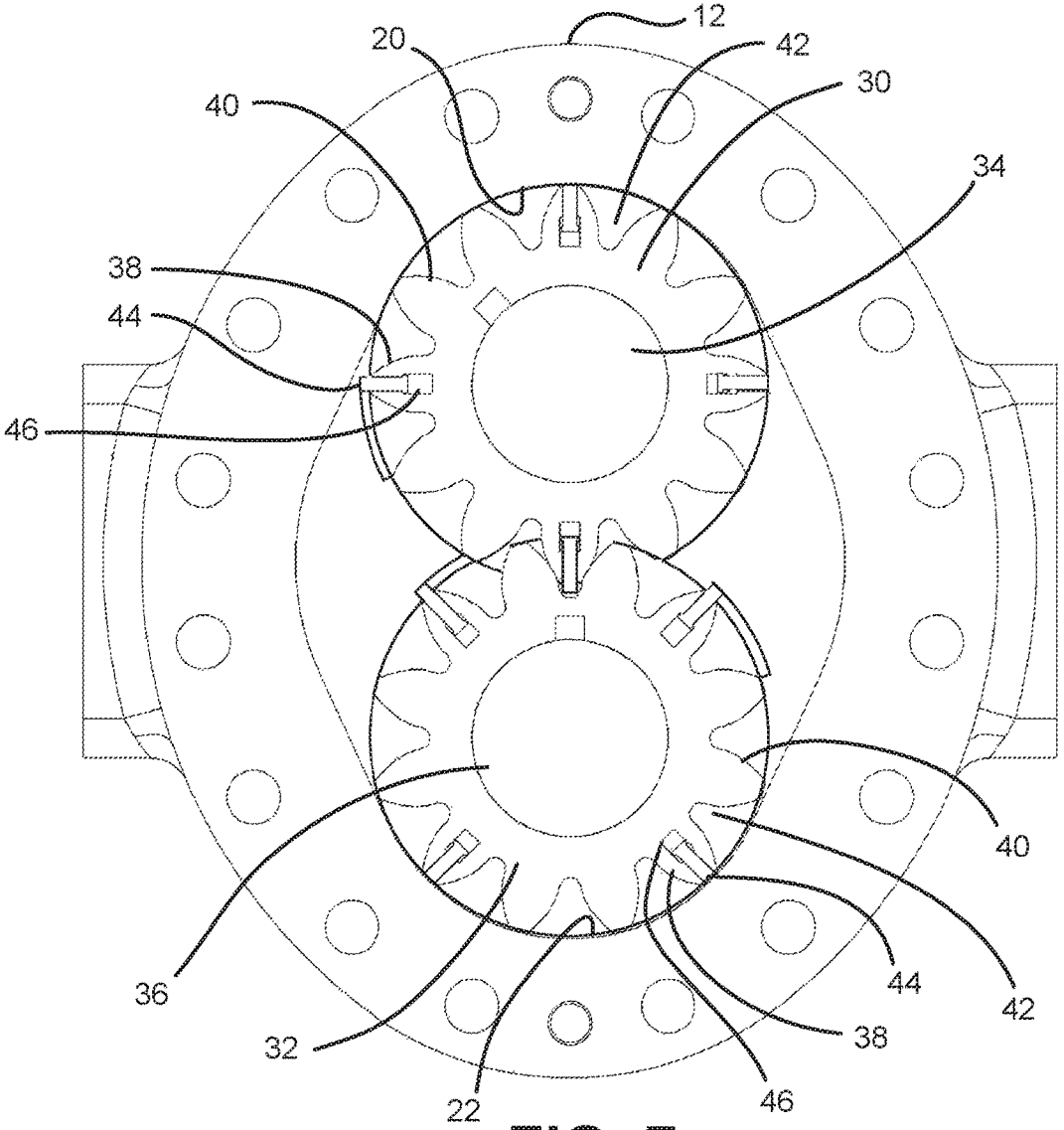
FIG. 7 is a side view of a fluid driving apparatus with helical gears according to another implementation described herein.

Housing 12 preferably includes cover 74 and a main body 80. While not being limited to a particular implementation, main body 80 may be a one-piece body (FIG. 5) or may include a plurality of pieces that combine to form the main body. FIG. 6 depicts an example of fluid drive apparatus 10 with main body 80 including a plurality of pieces. In particular, main body 80 shown in FIG. 6 includes a center section 82 and a bottom section 84 coupled to center section 82 via threaded connectors 86 into matching bores 87. The bottom section 84 is thereby a separate side cover bolted to center section 82 to form the main body 80. Cover 74 is shown bolted to main body 80 of the housing 12 via threaded connectors 78 into matching bores 79.

As can be seen in FIGS. 5 and 6, main body 80 contains piston 62 and spring 60. In FIG. 6 piston 62 is shown in center section 82, and spring 60 is shown in spring chamber 72 residing in center section 82 and extending into the bottom section 84. Both of the side covers, that is, cover 74 and bottom section 84, may include bearings or bushings 88 that support gear shafts 34, 36. Lateral end clearance may exist between the ends of the gear shafts 34, 36 and respective ends 90 of channels 92 that bearings/bushings 88 fit into.

Still referring to FIG. 6 two different bearing units are shown as examples of lateral clearance pressure piston configurations to illustrate that the bearing units are not limited to any one example. In one example, piston 62 presses against bearing 88, which slides inside its bore, and presses floating side plate 52 against the sides of gears 30, 32. FIG. 6 shows a second example of a bearing unit 94 housed in a chamber 96 of bottom section 84. Bearing unit 94 includes a piston 98 that presses directly against floating side plate 52. Bearing unit 94 further includes a compression spring 100 adapted to apply a bias against adjacent piston 98. An o-ring 102 may be placed between piston 98 and main body 80 to further prevent leakage.

Tunnel 70 is a passageway connecting chambers 96, 72 behind pistons 98, 62 to the discharge side of the pump. As discussed above with piston 62, higher liquid pressure on the discharge side of the pump is transmitted through tunnel 70 to hydraulically actuate piston 100 and further maintain a tight fitted relationship between floating side plates 50, 52 opposite gears 30, 32. While not being limited to a particular theory, gear shaft 34 is a drive shaft extending out of the housing 12 for coupling to the pump motor. A grommet 104, preferably made of a resilient material (e.g., rubber, polypropylene, plastic, resin) or a mechanical seal, is fitted within housing 12 about gear shaft 34 for providing a liquid seal.

In implementations described herein, a pump fluid driving apparatus includes a housing having a chamber, with two gears mounted within the chamber. The housing includes a first rounded wall section and a second rounded wall section, the first and second rounded wall sections defining at least a portion of the chamber. The gears have teeth located about their respective peripheries and operatively positioned with the teeth of the first gear and the teeth of the second gear intermeshed for all angular positions. The teeth include slotted teeth and solid teeth, each of the slotted teeth and solid teeth having a same profile along a right flank and a left flank, with each of the slotted teeth having a vane slot with an opening at the tip of the slotted tooth and a radially extending vane extending from the vane slot, each radially extending vane being movable within the respective vane slot and being configured to contact the respective first or second rounded wall sections.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A pump fluid driving apparatus, comprising:

a housing having a chamber, the housing including a first rounded wall section and a second rounded wall section, the first and second rounded wall sections defining at least a portion of the chamber; and a first gear and a second gear that is identical to the first gear, with the first and second gears mounted for rotation about their centers within the chamber and disposed adjacent, respectively, the first and second rounded wall sections, the first and second gears having teeth located about their respective peripheries and operatively positioned with the teeth of the first gear and the teeth of the second gear intermeshed for rotation of the first and second gears, wherein the teeth include slotted teeth and solid teeth arranged with uniform spacing about the respective peripheries, with each of the slotted teeth having a vane slot and a radially extending vane extending from the vane slot, each radially extending vane being movable within the respective vane slot and being configured to contact the respective first or second rounded wall sections.

2. The apparatus of claim 1, wherein each vane slot is located within the respective slotted tooth symmetrically between a right and a left flank of the respective slotted tooth.

3. The apparatus of claim 1, wherein the repeating pattern uniform spacing includes a gap between each of the teeth, each gap having the same dimensions.

4. The apparatus of claim 1, further comprising;

a biasing member disposed within each vane slot and against the radially extending vane, the biasing member configured to urge the radially extending vane toward the respective first or second rounded wall section.

5. The apparatus of claim 1, the first gear and the second gear having a circular shape.

6. The apparatus of claim 1, the first gear and the second gear having helical teeth.

7. The apparatus of claim 1, the first and second rounded wall sections having a radius that is greater than a radius of the first and second gears.

8. The apparatus of claim 1, further comprising:

a floating side plate member laterally disposed about the first and second gears to seal off liquid within the chamber.

9. The apparatus of claim 1, wherein all of the teeth have a same right flank profile and a same left flank profile.

10. The apparatus of claim 1, wherein no more than half of the teeth are slotted teeth.

11. The apparatus of claim 1, wherein no more than one third of the teeth are slotted teeth.

12. A pump fluid driving apparatus, comprising:

a housing having a chamber, the housing including a first rounded wall section and a second rounded wall section, the first and second rounded wall sections defining at least a portion of the chamber; and a first gear and a second gear that is identical to the first gear, with the first and second gears mounted for rotation about their centers within the chamber and disposed adjacent, respectively, the first and second rounded wall sections, the first and second gears having teeth located about their respective peripheries and operatively positioned with the teeth of the first gear and the teeth of the second gear intermeshed for all angular positions in a rotation of the first and second gears, wherein the teeth include slotted teeth and solid teeth, each of the teeth having a same profile along a right flank and a left flank, with each of the slotted teeth having a vane slot with an opening at an end of the slotted tooth and a radially extending vane extending from the vane slot, each radially extending vane being movable within the respective vane slot and being configured to contact the respective first or second rounded wall sections.

13. The apparatus of claim 12, wherein each vane slot is located within the respective slotted tooth between the right and the left flank of the respective slotted tooth.

14. The apparatus of claim 12, wherein each gear includes a repeating pattern of the slotted teeth and solid teeth about the respective peripheries.

15. The apparatus of claim 12, further comprising;

a biasing member disposed within each vane slot and against the radially extending vane, the biasing member configured to urge the radially extending vane toward the respective first or second rounded wall section.

16. The apparatus of claim 12, the first gear and the second gear each having a circular shape.

17. The apparatus of claim 12, wherein no more than half of the teeth in each of the first and second gears are slotted teeth.

18. The apparatus of claim 12, wherein each of the radially extending vanes extends beyond a tip of one of the slotted teeth at a distance that is greater than a clearance between the first gear its respective rounded wall section.

* * * * *